US009229358B2

(12) United States Patent
Ogino

(10) Patent No.: US 9,229,358 B2
(45) Date of Patent: Jan. 5, 2016

(54) DEVELOPING APPARATUS, PROCESS CARTRIDGE, AND INTERVAL GUARANTEE MEMBER

(71) Applicant: CANON KABUSHIKI KAISHA, Tokyo (JP)

(72) Inventor: Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/302,245

(22) Filed: Jun. 11, 2014

(65) Prior Publication Data

US 2014/0369720 A1 Dec. 18, 2014

(30) Foreign Application Priority Data

Jun. 14, 2013 (JP) ..... 2013-125717

(51) Int. Cl.
*G03G 15/09* (2006.01)
*G03G 15/08* (2006.01)
*G03G 21/18* (2006.01)

(52) U.S. Cl.
CPC ..... *G03G 15/0813* (2013.01); *G03G 21/18* (2013.01)

(58) Field of Classification Search
CPC ..... G03G 21/1867; G03G 2221/1861; G03G 21/1853; G03G 21/186; G03G 2221/1654; G03G 2221/1657; G03G 21/1647; G03G 2221/1884; G03G 15/0813; G03G 21/1633; G03G 21/1864; G03G 15/757; G03G 21/1871
See application file for complete search history.

(56) References Cited

U.S. PATENT DOCUMENTS 6,044,235 A * 3/2000 Hashimoto ..... 399/99
2014/0314439 A1* 10/2014 Yasui et al. ..... 399/103
2014/0314444 A1* 10/2014 Ogino ..... 399/111

FOREIGN PATENT DOCUMENTS

JP 3679665 B2 8/2005

* cited by examiner

*Primary Examiner* — Roy Y Yi
(74) *Attorney, Agent, or Firm* — Canon U.S.A., Inc. IP Division

(57) ABSTRACT

A developing apparatus used in an image forming apparatus including a developer bearing member configured to develop a latent image formed on an image bearing member and rotate together with the image bearing member so that opposed surfaces thereof rotate in the same direction, an interval guarantee member configured to maintain a distance between the developer bearing member and the image bearing member by coming into abutment with the developer bearing member and the image bearing member, and a biasing member configured to bias the interval guarantee member toward the upstream side in the direction of rotation of the developer bearing member by applying an elastic force generated by elastic deformation on the interval guarantee member.

20 Claims, 10 Drawing Sheets

DEVELOPING APPARATUS, PROCESS CARTRIDGE, AND INTERVAL GUARANTEE MEMBER

BACKGROUND OF THE INVENTION

1. Field of the Invention

This disclosure relates to an interval guarantee member configured to maintain a distance between an image bearing member and a developer bearing member, a developing apparatus and a process cartridge provided with the interval guarantee member.

A developing apparatus is used for an image forming apparatus. The term "the image forming apparatus" used here includes electrophotographic copying machines, electrophotographic printers (for example, laser beam printers, LED printers, and the like) configured to form images on recording medium using, for example, an electrophotographic image forming system, and facsimile apparatus and word processors. The process cartridge is configured to be detachably attachable with respect to an apparatus body of the image forming apparatus.

2. Description of the Related Art

In the related art, in the image forming apparatus using the electrophotographic image forming process, an interval guarantee member referred to as a spacer is provided at an end of the developing roller in order to maintain an interval and a distance between a photosensitive drum (an image bearing member) and a developing roller (a developer bearing member) to be constant.

The spacer is clamped between the photosensitive drum and the developing roller by a biasing force of a spring or the like, and controls the interval between the photosensitive drum and the developing roller to be constant.

As the spacers of the related art, in addition to a type in which the spacer is rotated by itself in association with the rotation of the developing roller or the photosensitive drum, there is proposed a type in which the spacer is supported rotatably with respect to the developing roller but does not rotate by itself even though the developing roller rotates (For example, Japanese Patent No. 3679665).

SUMMARY OF THE INVENTION

This disclosure is intended to further improve the related art. This disclosure is intended to restrain an interval guarantee member from moving in association with the rotation of a developer bearing member in a simple configuration.

A representative configuration disclosed in this application is a developing apparatus used in an image forming apparatus including: a developer bearing member configured to develop a latent image formed on an image bearing member and rotate together with the image bearing member so that opposed surfaces thereof rotate in the same direction; an interval guarantee member configured to maintain a distance between the developer bearing member and the image bearing member by coming into abutment with the developer bearing member and the image bearing member, the interval guarantee member having a first developer bearing member sliding contact portion that comes into sliding contact with the developer bearing member on an upstream side of a line connecting a center of rotation of the developer bearing member and a center of rotation of the image bearing member in the direction of rotation of the developer bearing member and a first image bearing member sliding contact portion that comes into sliding contact with the image bearing member on the upstream side of the line in the direction of rotation of the image bearing member; and a biasing member configured to bias the interval guarantee member toward the upstream side in the direction of rotation of the developer bearing member by applying an elastic force generated by elastic deformation on the interval guarantee member.

Further features of the present invention will become apparent from the following description of exemplary embodiments with reference to the attached drawings.

BRIEF DESCRIPTION OF THE DRAWINGS

FIG. 9 is a cross-sectional view of a spacer or the like.

FIG. 10A is a cross-sectional view of the spacer or the like.

DESCRIPTION OF THE EMBODIMENTS

Example 1

Figure 1:
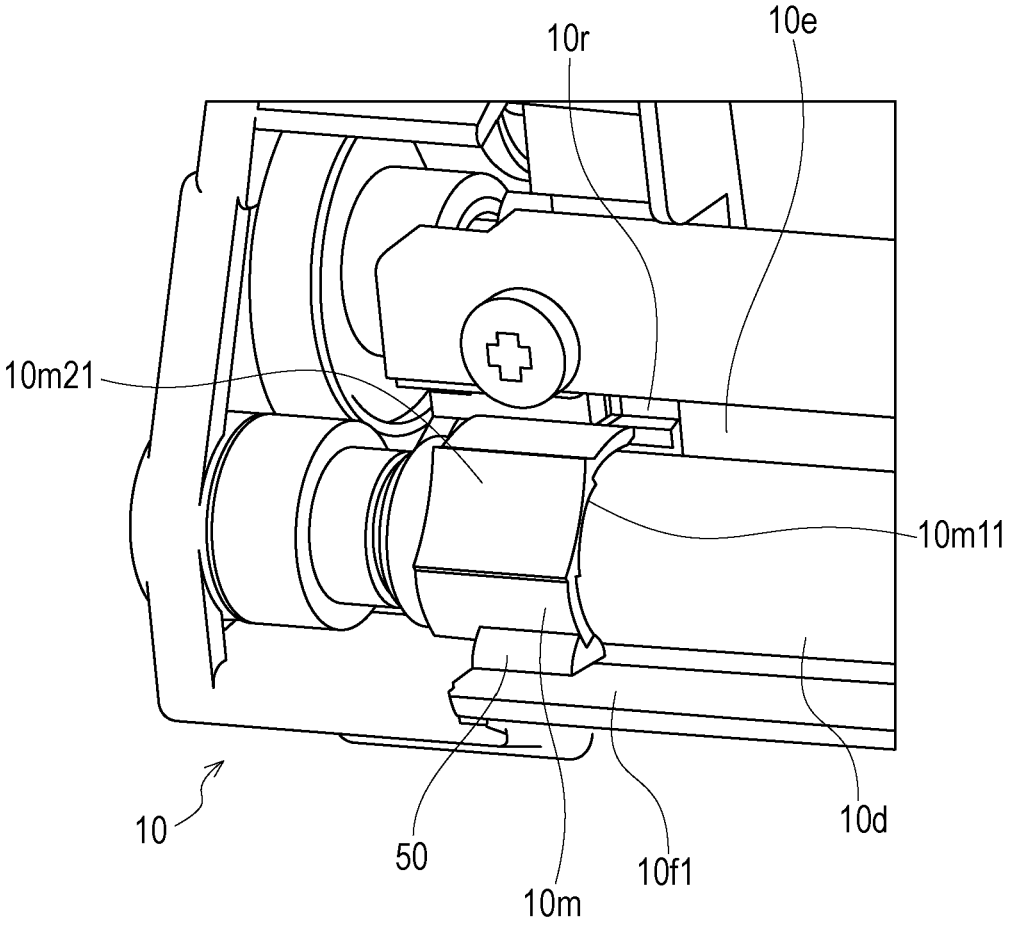
FIG. 1 is an explanatory drawing of a developing apparatus.

Referring now to the drawings, preferred embodiments of this disclosure will be described in detail below with reference to examples. However, the scope of this disclosure is not specifically limited to dimensions, materials, and shapes of components, and relative arrangements disclosed in the embodiment unless otherwise specifically limited. The materials and the shapes of members described once in the following description are the same throughout unless otherwise specifically described again.

In the description given below, the longitudinal direction of a process cartridge corresponds to a direction of an axial line of a developing roller (the direction parallel to a direction in which the axis of rotation extends).

Figure 2:
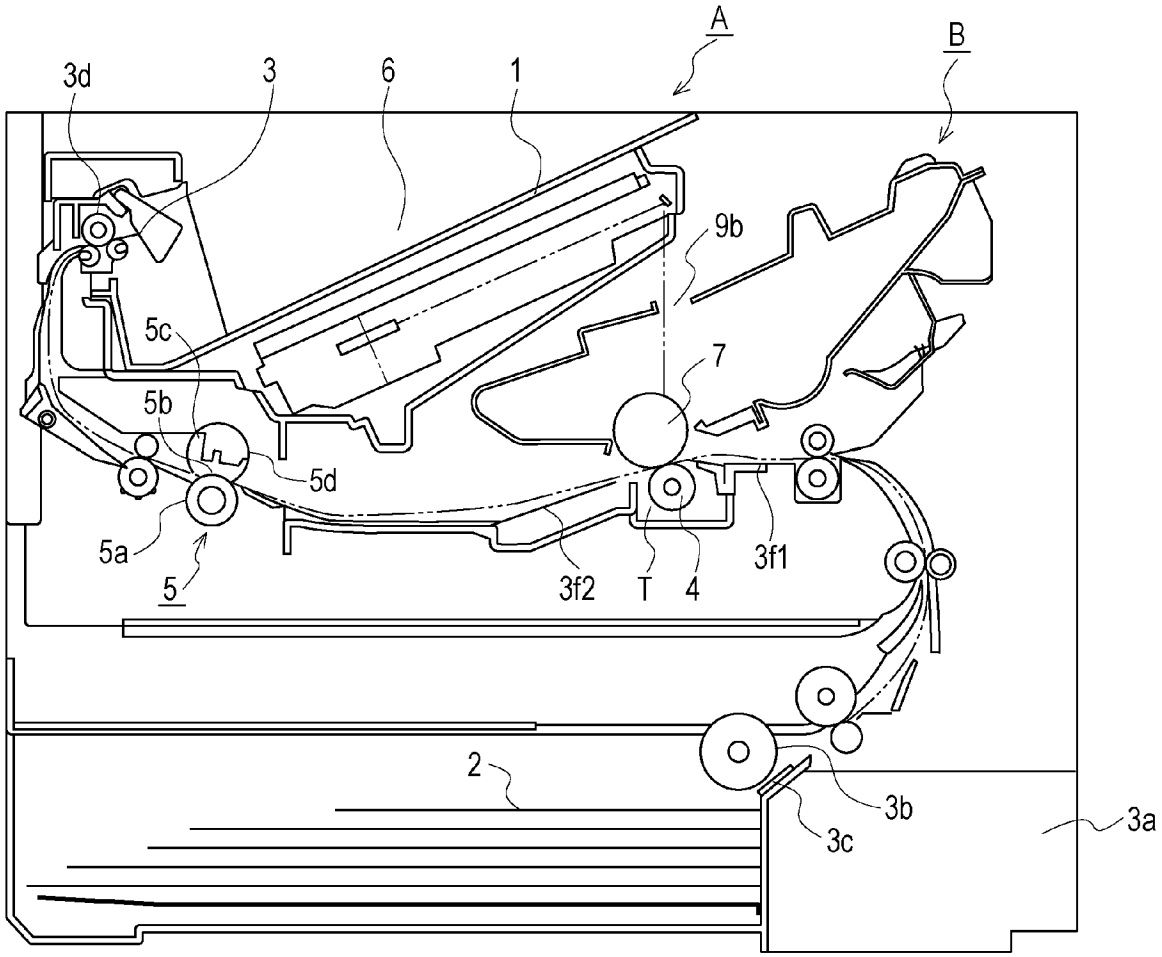
FIG. 2 is an explanatory drawing of an image forming apparatus.

Description of General Configuration of Electrophotographic Image Forming Apparatus First of all, a general configuration of the electrophotographic image forming apparatus (hereinafter, "image forming apparatus") will be described in brief with reference to FIG. 2. FIG. 2 is a pattern diagram illustrating a cross section of the image forming apparatus having a process cartridge of the embodiment disclosed here mounted thereon and, more specifically, a pattern diagram illustrating a cross section of a laser beam printer as a configuration of the image forming apparatus.

As illustrated in FIG. 2, an image forming apparatus (laser beam printer) A of Example 1 is configured to irradiate the photosensitive drum 7 having a drum shape with information light on the basis of image information from an optical system 1 as an optical device, and form an electrostatic latent image on the photosensitive drum 7. The electrostatic latent image is developed by a developer (hereinafter, referred to as "toner"), and a toner image is formed. Synchronously with the formation of the toner image, a recording medium (for example, recording paper, OHP sheet, fabric and the like) 2 is fed from a cassette 3*a* one by one separately by a pickup roller 3*b* and a pressure-contact member 3*c* in press contact thereto.

The fed recording medium 2 is conveyed along a conveyance guide 3*f*1 to a transfer portion T where the photosensitive drum 7 of a process cartridge B and a transfer roller 4 as a transfer device oppose each other.

The recording medium 2 conveyed to the transfer portion T on which the toner image formed on the photosensitive drum 7 by the transfer roller 4 having a voltage applied thereto is transferred, and is conveyed to a fixing device 5 along a conveyance guide 3*f*2.

The fixing device 5 includes a drive roller 5*a* and a fixing rotating body 5*d* having a heater 5*b* integrated therein and is composed of a cylindrical seat which is rotatably supported by a supporting member 5*c*, and fixes a toner image transferred by applying heat and pressure to the recording medium 2 passing therethrough.

A discharge roller 3*d* is configured to convey the recording medium 2 having the toner image fixed thereto and discharge the recording medium 2 to a discharge unit 6 through a reversal conveying path. In the embodiment disclosed here, the pickup roller 3*b*, the pressure-contact member 3*c*, the discharge roller 3*d*, and the like constitute a conveying device 3.

Process Cartridge

Figure 3:
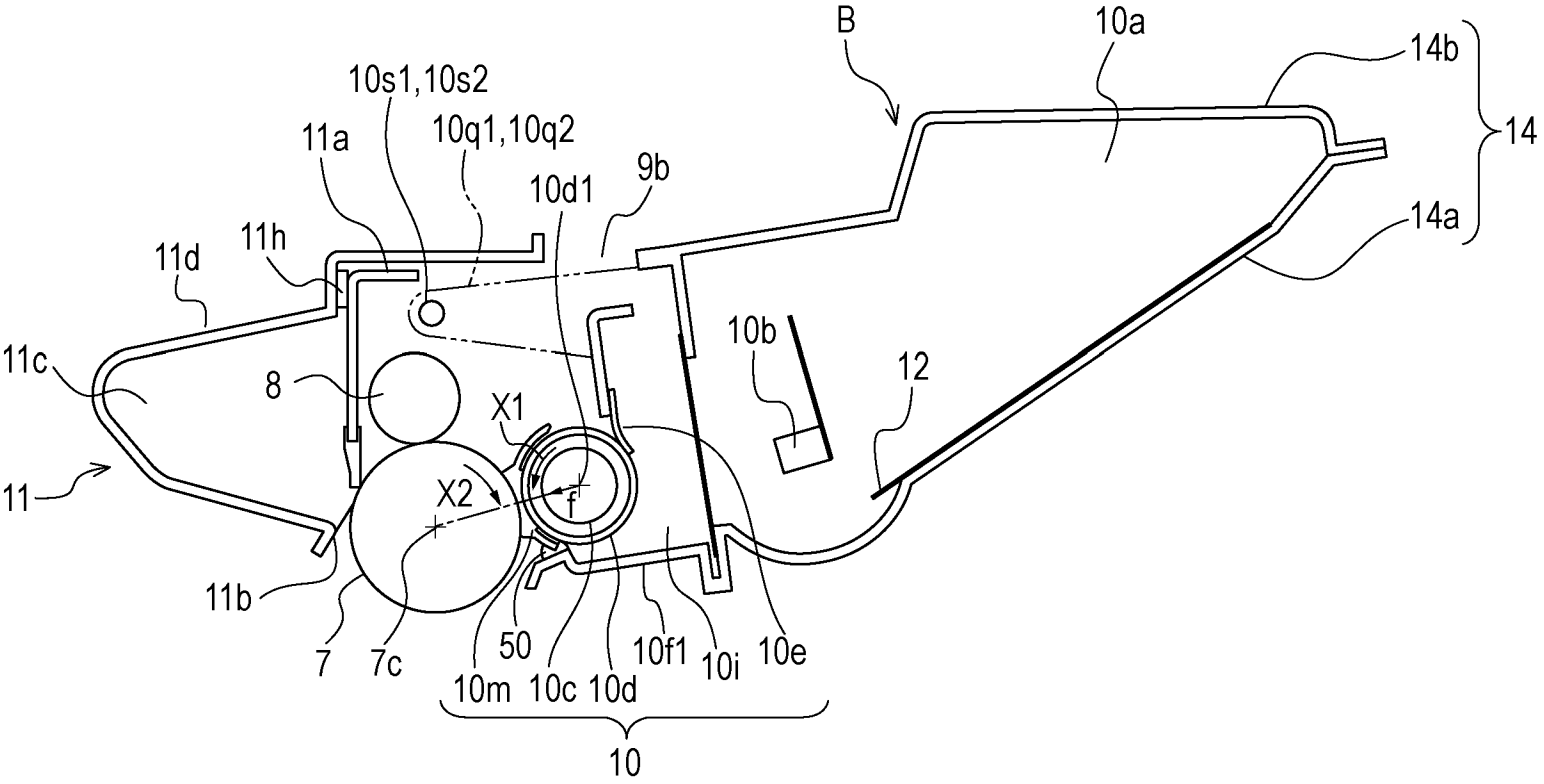
FIG. 3 is an explanatory drawing illustrating a process cartridge.

Subsequently, a general configuration of the process cartridge will be described in brief with reference to FIG. 1 to FIG. 3. FIG. 3 is a pattern diagram illustrating a cross section of the process cartridge of the embodiment disclosed here.

A process cartridge B according to the embodiment disclosed here includes a drum unit 11 and a developing unit 10 coupled with the drum unit 11. The drum unit 11 includes a photosensitive drum 7 and a drum frame member 11*d* as a frame member for rotatably supporting the photosensitive drum 7. Furthermore, the drum frame member 11*d* includes a cleaning blade 11*a* and a charging roller 8 integrated (supported) therein. The photosensitive drum 7 is an image bearing member configured to allow formation of an image (latent image, toner image) on a surface thereof. The drum unit 11 is an image bearing member unit configured to retain the image bearing member (the photosensitive drum 7).

The developing unit 10 includes a developing roller 10*d* and a developing frame 10*f*1 as a frame member configured to support the developing roller 10*d*. The developing roller 10*d* is a developer bearing member configured to bear developer for developing the latent image formed on the photosensitive drum. The developing frame 10*f*1 constitutes the frame member of the developing unit in cooperation with a toner frame member 14. A toner chamber 10*a* (developer storage portion) for storing toner (developer) is defined mainly by the toner frame member 14. The toner frame member 14 includes a frame member body 14*a* and a lid member 14*b* configured to join with the frame member body 14*a*.

The developing unit 10 corresponds to a developing apparatus in Example 1. In Example 1, the developing apparatus (the developing unit 10) has a configuration detachably attachable with respect to an apparatus body of the image forming apparatus as part of the process cartridge.

In the case of the process cartridge B according to the embodiment disclosed here, an image is formed in the following manner. First of all, the image forming apparatus is configured to rotate the photosensitive drum 7 having a photosensitive layer thereon, and apply a voltage to a charging roller 8, which corresponds to a charging device, to charge the surface of the photosensitive drum 7 evenly. The charged photosensitive drum 7 is exposed through an exposure opening 9*b* with information light (light image) on the basis of image information from the optical system 1 as illustrated in FIG. 2. Accordingly, an electrostatic latent image is formed on the surface of the photosensitive drum 7, and the electrostatic latent image is developed as a toner image (developer image) by the developing unit 10.

The image forming apparatus feeds toner in the toner chamber 10*a* defined by the toner frame member 14 of the developing unit 10 to a developing chamber 10*i* by a rotatable developer conveying member (hereinafter, referred to as a "toner feeding member") 10*b* and an elastic sheet 112. The elastic sheet 12 is located in a region of rotation of the toner feeding member 10*b*, and is configured to feed the toner to the developing chamber 10*i* by coming into contact (interference) with the toner feeding member 10*b*.

The image forming apparatus rotates the developing roller 10*d* having a fixed magnet 10*c* integrated therein as illustrated in FIG. 3. In association with the rotation of the developing roller 10*d*, a toner layer provided with a frictional charge by a developing blade 10*e* as a developer restricting member is formed on the surface of the developing roller 10*d*. By transferring the toner to the photosensitive drum 7 in accordance with the electrostatic latent image, a toner image is formed and visualized.

After a voltage having a polarity opposite to that of the toner image has been applied to the transfer roller 4 and the toner image has been transferred to the recording medium 2, the image forming apparatus scraps off residual toner on the photosensitive drum 7 by a cleaning blade 11*a* as a cleaning device. Simultaneously, the toner is scooped by a scooping sheet 11*b* and is collected in a removed toner storing unit 11*c*.

As illustrated in FIG. 3, the developing frame 10*f*1 includes arm portions 10*q*1 and 10*q*2 formed with coupling holes 10*s*1 and 10*s*2 at both end portions thereof.

By inserting coupling portions of the drum unit 11 into the coupling holes 10*s*1 and 10*s*2, the developing unit 10 including the developing roller 10*d* is rotatably supported by the drum unit 11 having the cleaning blade 11*a*.

As illustrated in FIG. 3, by the rotational movement of the developing unit 10 with respect to the drum unit 11, the photosensitive drum 7 and the developing roller 10*d* are allowed to move relative to each other. A predetermined pressing force f directed toward the drum unit 11 is applied to the developing unit 10 by the own weight of the developing unit 10 and a biasing member (such as a spring) provided between the developing unit 10 and the drum unit 11. With the application of the pressing force f, the developing unit 10 is biased in the direction in which the developing roller 10*d* gets closer to the photosensitive drum 7.

As illustrated in FIG. 1, an end seal 10*r* configured to prevent leakage of toner from both end portions of the developing roller 10*d* is mounted on the developing frame 10*f*1.

Spacers 10*m* (interval guarantee members) are disposed at end portions (both end portions) of the developing roller 10*d*. The spacers 10*m* come into abutment with the photosensitive drum 7 so that the developing roller 10*d* face the photosensitive drum 7 in parallel thereto with a predetermined interval therewith.

Spacer Configured to Hold Interval Between Developing Roller and Photosensitive Drum Subsequently, a configuration of the spacers 10*m* configured to maintain an interval between the developing roller 10*d* and the photosensitive drum 7 will be described more specifically with reference to FIG. 1 and FIG. 4 and FIG. 5.

Figure 4:
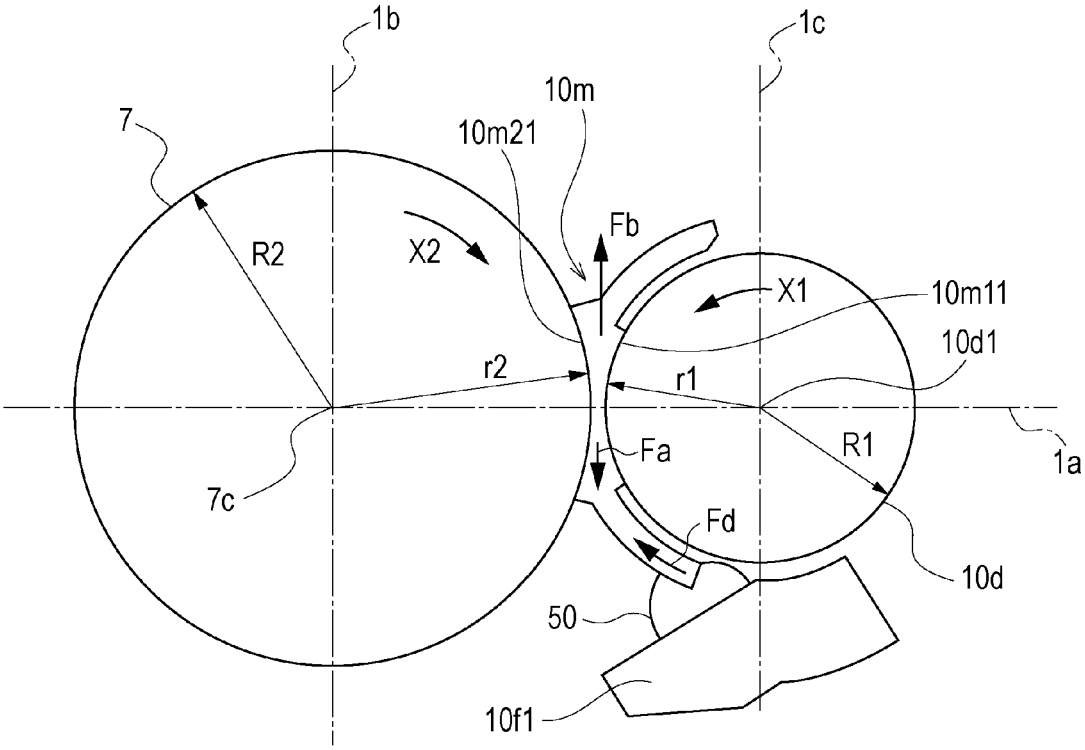
FIG. 4 is an explanatory drawing illustrating a configuration of the developing apparatus.
Figure 5:
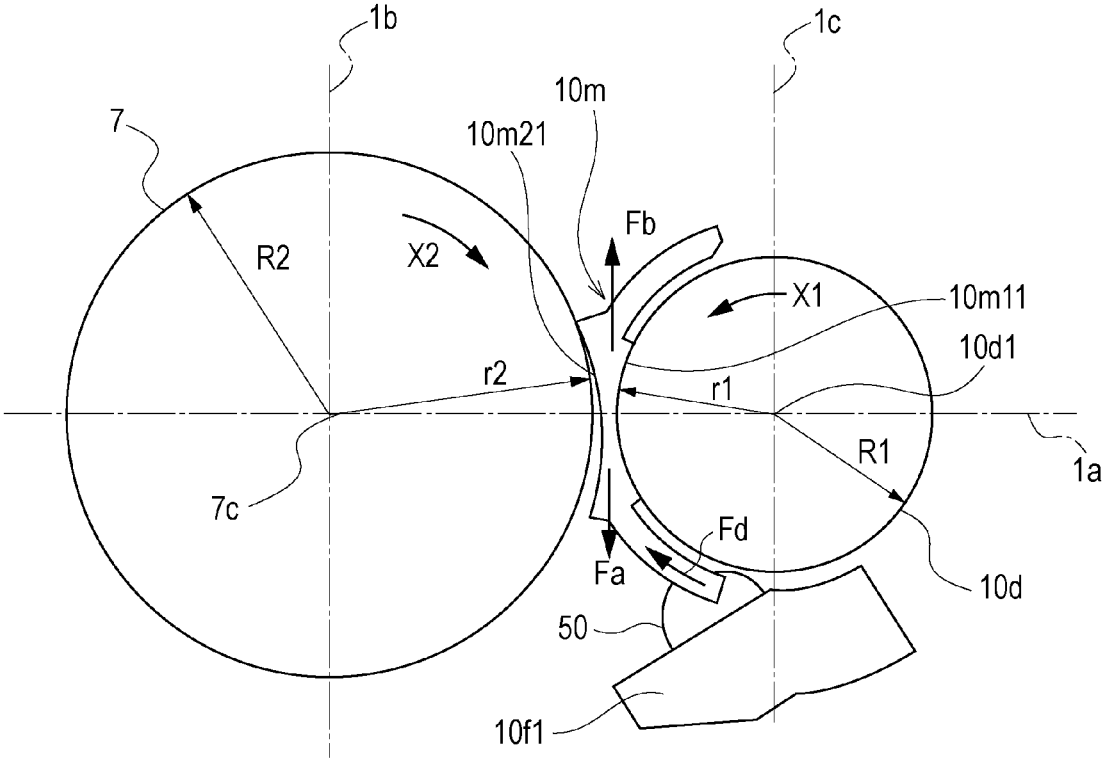
FIG. 5 is an explanatory drawing illustrating a configuration of the developing apparatus.

As illustrated in FIG. 1 and FIG. 4 and FIG. 5, the spacer 10*m* includes a developing roller contact surface 10*m*11 extending along the developing roller 10*d* and a photosensitive drum contact surface 10*m*21 extending along the photosensitive drum 7. The developing roller contact surface 10*m*11 and the photosensitive drum contact surface 10*m*21 are distance maintaining members configured to maintain the distance between the developing roller 10*d* and the photosensitive drum 7 respectively constant by coming into contact with the developing roller 10*d* and the photosensitive drum 7.

The developing roller contact surface 10*m*11 has an arcuate shape having a radius r1, which is substantially the same as the outer peripheral radius R1 of the developing roller 10*d*. In the same manner, the photosensitive drum contact surface 10*m*21 has a radius r2, which is substantially the same as the outer peripheral radius R2 of the photosensitive drum 7.

The spacers 10*m* are mounted on both end portions of the surface of the developing roller 10*d* in the longitudinal direction as illustrated in FIG. 1. Here, the surface of the developing roller 10*d* on which the spacers 10*m* are mounted may be either portions on which the toner layer is formed or portions on which the toner layer is not formed.

A biasing member 50 is provided between the spacer 10*m* and the developing frame 10*f*1, and the biasing member 50 is an elastic member and is formed of a substance having elasticity such as elastomer, rubber, and sponge. In other words, the biasing member 50 is an elastic deforming member (elastic member) which is elastically deformable. The biasing member 50 is fixed to the developing frame 10*f*1, and comes into contact with the spacer 10*m*. Part of the spacer 10*m* is configured to dig into the biasing member 50.

As illustrated in FIG. 4, the pressing force f illustrated in FIG. 3 brings the spacer 10*m* into abutment with the surfaces of the developing roller 10*d* at a developing roller sliding contact portion 10*p*11 and with the surface of the photosensitive drum 7 at the photosensitive drum contact surface 10*m*21. With this configuration, the developing roller 10*d* and the photosensitive drum 7 are held at a constant interval.

In a state in which the spacer 10*m* is positioned by the developing roller 10*d* and the photosensitive drum 7 as illustrated in FIG. 4, the biasing member 50, which is an elastic member, is compressed between the spacer 10*m* and the developing frame 10*f*1, whereby the spacer 10*m* receives a biasing force Fd illustrated in FIG. 4 from the biasing member 50. The biasing force Fd is a force not smaller than "0", directed toward the upstream side in the direction of rotation of the developing roller 10*d* and the photosensitive drum 7.

At this time, a coefficient of elasticity and an amount of compression of the biasing member 50, which is an elastic member, are selected so as to allow the spacer 10*m* to be positioned between the developing roller 10*d* and the photosensitive drum 7, whereby the biasing force Fd applied from the biasing member 50 to the spacer 10*m* is adjusted.

At the time of image forming, the developing roller 10*d* and the photosensitive drum 7 rotate respectively in directions X1 and X2 in which peripheral surfaces thereof at opposing position (opposing surfaces) rotate in the same direction.

At this time, as illustrated in FIG. 4, the spacer 10*m* receives a force Fa which acts to move the spacer 10*m* to the downstream side of the direction of rotation of the developing roller 10*d* and the photosensitive drum 7 by a sliding contact between the developing roller 10*d* and the photosensitive drum 7.

The force Fa is determined by a frictional force generated on the developing roller contact surface 10*m*11 of the spacer 10*m* and a frictional force generated on the photosensitive drum contact surface 10*m*21.

When the biasing member 50, which is an elastic member, is compressed between the spacer 10*m* and the developing frame 10*f*1, the spacer 10*m* receives a biasing force Fd, which acts to move the spacer 10*m* to the upstream side of the direction of rotation of the developing roller 10*d* and the photosensitive drum 7 from the biasing member 50. The force Fd is a force against the force Fa.

Furthermore, a pressing force f (see FIG. 3) generates a force Fb which acts to hold the spacer 10*m* between the developing roller 10*d* and the photosensitive drum 7 acting on the spacer 10*m*. When the spacer 10*m* stays between the developing roller 10*d* and the photosensitive drum 7 without being moved by the rotation of the developing roller 10*d* and the photosensitive drum 7, it means that the forces Fa, Fd, and Fb are balanced, so that an equation Fb+Fd−Fa=0 is satisfied.

There is a case where a frictional force on the spacer 10*m* between the developing roller contact surface 10*m*11 and the photosensitive drum contact surface 10*m*21 rises temporarily. The causes of the rise of the frictional force include abrasion of the spacer with long time of use, entry of foreign substances such as toner between the contact surfaces (10*m*11 and 10*m*21) and the developing roller 10*d* or the photosensitive drum 7, and other various causes.

At this time, as illustrated in FIG. 5, a force Fa which acts to move the spacer 10*m* to the downstream side of the direction of rotation of the developing roller 10*d* and the photosensitive drum 7 is increased, and may exceeds the force Fb by which the spacer 10*m* is held between the developing roller 10*d* and the photosensitive drum 7. In this case, the spacer 10*m* moves to the downstream side of the direction of rotation of the developing roller 10*d*.

At that time, the biasing member 50, which corresponds to an elastic member, is compressed between the spacer 10*m* and the developing frame 10*f*1, and applies a force Fa corresponding to the amount of movement of the spacer 10*m* to the spacer 10 to bias the spacers 10*m* to the upstream side of the direction of rotation of the developing roller 10*d*.

Even though the spacer 10*m* acts to move in association with the rotation of the developing roller 10*d* and the photosensitive drum 7, the biasing force from the biasing member 50 may keep the spacer 10*m* at a position between the developing roller 10*d* and the photosensitive drum 7 which does not cause a substantial image failure.

In other words, the biasing member 50 is elastically deformed when the spacer 10*m* acts to move in association with the rotation of the developing roller 10*d* and the photosensitive drum 7. The biasing member 50 applies a repulsive force (elastic force) that acts to cancel the elastic deformation to the spacer 10*m*. Accordingly, the biasing member 50 biases the spacer 10*m* toward the upstream side of the direction of rotation of the developing roller 10*d*, and prevents the movement of the spacer 10*m*.

The biasing member 50 provided between the spacer 10*m* and the developing frame 10*f*1 also has a function to restrict (prevent) the spacer 10*m* to move to the downstream side of the direction of rotation of the developing roller 10*d* or the photosensitive drum 7 when a vibration or an impact is applied to the developing unit 10.

With the configuration as described above, the biasing member 50 provided between the spacer 10*m* and the developing frame 10*f*1 contributes to prevent the spacer 10*m* from moving in association with the rotation of the developing roller 10*d* and the photosensitive drum 7 at the time of image formation by the elastic force of the biasing member 50. The spacer 10*m* can stay at a position between the developing roller 10*d* and the photosensitive drum 7 which does not cause a substantial image failure.

In this configuration, the spacer 10*m*, which is a SD gap guarantee member, is prevented from moving in association with the rotation of the developing roller 10*d* and the photosensitive drum 7, and the interval and the distance between the photosensitive drum 7 and the developing roller 10*d* can be maintained stably.

In the embodiment described above, a case where the developing roller contact surface 10*m*11 and the photosensitive drum contact surface 10*m*21 of the spacer have arcuate shapes having radii substantially the same as the outer peripheral radii of the developing roller 10*d* and photosensitive drum 7, respectively, has been described. However, this disclosure is not limited thereto, and the spacers 10*m* having any shape may be suitably applied irrespective of the shapes of the developing roller contact surface 10*m*11 and the photosensitive drum contact surface 10*m*21 as long as the position of the spacer 10*m* is fixed by being clamped between the developing roller 10*d* and the photosensitive drum 7.

Figure 9:
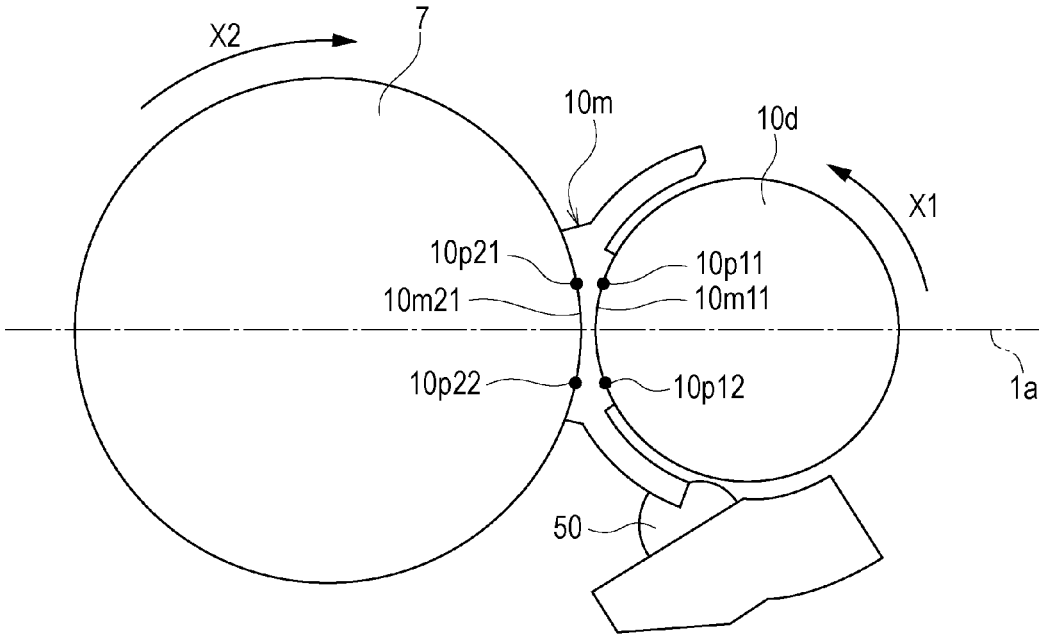

In Example 1, the reason why the position of the spacer 10*m* is fixed will be described with reference to FIG. 9. FIG. 9 is a cross-sectional view of the spacer 10*m* of Example 1 taken along the line extending perpendicularly with respect to the center axis of the developing roller 10*d*, and is a cross-sectional view equivalent to FIG. 4. The spacer 10*m* of Example 1 comes into contact with the photosensitive drum 7 and the developing roller 10*d* both at the upstream side and the downstream side of a nearest position at which the distance between the developing roller 10*d* and the photosensitive drum 7 is the shortest. Detailed description will be given below.

The developing roller contact surface 10*m*11 comes into abutment with the developing roller 10*d* over the substantially entire area. Consequently, the developing roller contact surface 10*m*11 comes into contact with the developing roller 10*d* respectively at the upstream and at the downstream of the line 1*a* in the direction of rotation X1 of the developing roller 10*d*. The line 1*a* is a line connecting a center of rotation of the developing roller 10*d* and a center of rotation of the photosensitive drum 7. As sliding contact portions of the spacer 10*m* which comes into contact (sliding contact) with the developing roller 10*d* includes a first developing roller sliding contact portion 10*p*11 located upstream of the line 1*a* and a second developing roller sliding contact portion 10*p*12 located downstream of the line 1*a*.

In Example 1, since the first developing roller sliding contact portion 10*p*11 and the second developing roller sliding contact portion 10*p*12 are on the same curved surface (developing roller contact surface 10*m*11), the first developing roller sliding contact portion 10*p*11 and the second developing roller sliding contact portion 10*p*12 are connected. However, the first developing roller sliding contact portion 10*p*11 and the second developing roller sliding contact portion 10*p*12 need not to be on the same plane, and may be separated.

In the same manner, the photosensitive drum contact surface 10*m*21 comes into abutment with the photosensitive drum 7 over the entire area. The photosensitive drum contact surface 10*m*21 comes into contact with the photosensitive drum 7 respectively at the upstream and the downstream of the line 1*a* in the direction of rotation X2 of the photosensitive drum 7, In other words, a sliding contact portions of the spacer 10*m* which comes into contact (sliding contact) with the photosensitive drum 7 includes a first photosensitive drum sliding contact portion 10*p*21 located upstream of the line 1*a* and a second photosensitive drum sliding contact portion 10*p*22 located downstream of the line 1*a*.

In Example 1, since the two photosensitive drum sliding contact portion 10*p*21, 10*p*22 are located on the same curved surface (photosensitive drum contact surface 10*m*21), the photosensitive drum sliding contact portion 10*p*21, 10*p*22 are connected. However, the photosensitive drum sliding contact portion 10*p*21, 10*p*22 need not to be on the same plane, and may be separated.

Developing roller sliding contact portions 10*p*11 and 10*p*12 correspond to first and second developer bearing member sliding contact portions (developing side sliding contact portions) which come into sliding contact with the developer bearing member when the developer bearing member (the developing roller 10*d*) rotates. The photosensitive drum sliding contact portions 10*p*21, 10*p*22 correspond to first and second image bearing member sliding contact portions (image bearing side sliding contact portions) which come into sliding contact with the image bearing member when the image bearing member (photosensitive drum 7) rotates.

The distance between the developing roller 10*d* and the photosensitive drum 7 is nearest on the line 1*a*. On the upstream side of the nearest position, if the width of the spacer 10*m* is larger than the shortest distance between the developing roller 10*d* and the photosensitive drum 7 (the distance on the line 1*a*), the movement of the spacer 10*m* along the direction of rotation X1 is restrained even when the developing roller 10*d* rotates.

As a matter of fact, the distance between the photosensitive drum sliding contact portion 10*p*21 and the developing roller sliding contact portion 10*p*11 is larger than the distance between the surfaces of the developing roller 10*d* and the photosensitive drum 7 on the line 1*a*. Therefore, the photosensitive drum sliding contact portion 10*p*21 and the developing roller sliding contact portion 10*p*11 come into contact with the photosensitive drum 7 and the developing roller 10*d* to restrain the spacer 10*m* from moving in directions of rotation X1 and X2.

In Example 1, the spacer 10*m* comes into contact with the photosensitive drum 7 at the photosensitive drum sliding contact portion 10*p*22 on the downstream side of the line 1*a*, and comes into contact with the developing roller 10*d* at the developing roller sliding contact portion 10*p*12 on the downstream side of the line 1*a*. Therefore, the spacer 10*m* does not move to the opposite side of the direction of rotation of the developing roller 10*d*. The spacer 10*m* includes the photosensitive drum sliding contact portion 10*p*21 and the developing roller sliding contact portion 10*p*11. Therefore, even when the developing roller 10*d* rotates, the spacer 10*m* does not move easily in the direction of rotation thereof. However, since the developing roller 10*d* and the photosensitive drum 7 rotate so as to move opposing surfaces thereof in the same direction. Therefore, a strong force is applied to the spacer 10*m* from the beginning in the directions of rotation X1 and X2 of the developing roller 10*d* and the photosensitive drum 7. Therefore, in Example 1, in order to restrain the movement of the spacer 10*m* more reliably, the biasing member 50 is provided on the developing frame 10*f*1.

The biasing member 50 constitute a rotation preventing unit portion, which prevents the movement of the spacer 10*m* together with the photosensitive drum sliding contact portion 10*p*21 and the developing roller sliding contact portion 10*p*11. The rotation preventing unit portions (50, 10*p*21, 10*p*11) prevent the spacer 10*m* from moving in the direction of rotations X1 and X2.

The photosensitive drum sliding contact portions 10*p*21, 10*p*22 of the photosensitive drum contact surface 10*m*21 and the developing roller sliding contact portions 10*p*11 and 10*p*12 of the developing roller contact surface 10*m*11 correspond to the distance maintaining members that maintain the distance between the developing roller 10*d* and the photosensitive drum 7 to be constant. When the movement of the spacer 10*m* is prevented, the positions of the respective sliding contact portions (10*p*21, 10*p*22, 10*p*11, and 10*p*12) do not move, so that the distance between the photosensitive drum 7 and the developing roller 10*d* is stably maintained by the spacer 10*m*.

The process cartridge explained in Example 1 has a configuration of forming a monochrome image. However, this disclosure is not limited thereto. A configuration in which a process cartridge includes a plurality of developing devices and forms images having a plurality of colors (for example, two-color images, three-color images, or full-color images) is also applicable.

An electrophotographic photosensitive member is not limited to the photosensitive drum and, for example, following members. First of all, a photoconductor is used as the photosensitive member, and the photoconductor include, for example, amorphous silicon, amorphous selenium, zinc oxide, titanium oxide, and organic photoconductor (OPC).

Examples of the shape of a member on which the photosensitive member is mounted include a drum shape and a belt shape. For example, the drum-shaped photosensitive member is achieved by depositing or coating the photoconductor on a cylinder formed of aluminum alloy or the like.

Although the configuration of the charging device employed in the embodiment described above is a so-called contact charging method, non-contact type chargers such as a corona charger, which does not come into contact with the photosensitive drum, may be employed as alternative configurations.

The charging device may be a blade (a charging blade), a pad type, a block type, a rod type, a wire type instead of the roller type as described above.

As a cleaning method of toner remaining on the photosensitive drum, a cleaning device may be configured by using a blade, a far brush, a magnetic blush, or the like.

The process cartridge described above means a member including at least the image bearing member and the developing device (developing apparatus) integrated into a cartridge and being configured to be detachably attachable to the apparatus body of the image forming apparatus. Then, the process cartridge may be detachably attached to the main body of the apparatus by a user by himself or herself. Therefore, maintenance of the main body of the apparatus may be performed by a user by himself or herself.

However, the spacer 10*m* is not applied only to the process cartridge. The spacer 10*m* of Example 1 may be applied even to a configuration in which the image bearing member (the photosensitive drum) and the developing apparatus are fixed to the image forming apparatus and the user does not replace these members.

In the embodiment described above, the process cartridge including the drum unit and the developing unit (developing apparatus) integrated therein has been exemplified. However, this disclosure is not limited thereto. A configuration in which the drum unit (image bearing member unit) having the photosensitive drum integrated therein and the developing apparatus are separate members, and are configured to be detachably attachable to the apparatus body of the image forming apparatus as separate cartridges is also applicable.

Furthermore, in the above-described embodiment, the laser beam printer is exemplified as the electrophotographic image forming apparatus. However, the present invention is not limited thereto. For example, this disclosure may also be applied as a matter of course to the electrophotographic image forming apparatuses such as electrophotographic copying machines, electrophotographic printers such as LED printers, facsimile apparatuses, word processors, or copying machines including these apparatuses (multifunction printers and the like).

In Example 1, the biasing member 50 is fixed to the developing frame 10*f*1. However, the biasing member 50 may be fixed to other portions of the developing unit 10. For example, the biasing member 50 may be fixed to another member supported by the developing frame 10*f*1.

Example 2

Subsequently, Example 2 of this disclosure will be described with reference to FIG. 3, and FIG. 6 to FIG. 8.

In Example 2, configurations and actions different from the example described above will be described, and components having the same configurations and functions are designated by the same reference numerals and description of the above-described example will be incorporated. Description will be incorporated by assigning the same component names.

Figure 6:
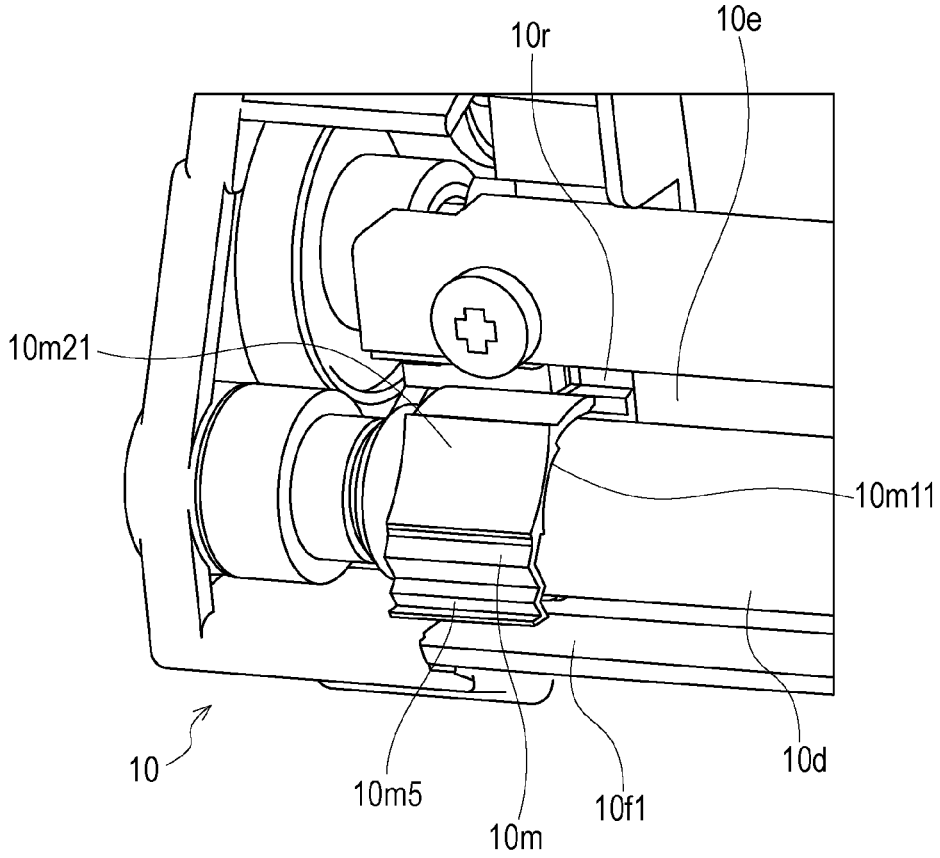
FIG. 6 is an explanatory drawing illustrating a configuration of the developing apparatus.

In Example 1, the biasing member 50 is provided on the developing frame 10*f*1. In contrast, in Example 2, part of the spacer 10*m* corresponds to a biasing member 10*m*5 as illustrated in FIG. 6. In other words, the biasing member 10*m*5 is configured integrally with the spacer 10*m*. However, Example 2 is not limited to such a configuration, and the biasing member 50 may be a member separate from a body portion of the spacer 10*m* as long as the biasing member 10*m*5 is provided on the spacer 10*m*. In such a case, the biasing member 50 may be fixed to the body portion of the spacer 10*m* with an adhesive agent.

The biasing member 10*m*5 has an elasticity, and comes into contact with the developing frame 10*f*1. In the same manner as the biasing member 50 of Example 1, the biasing unit 10*m*5 of Example 2 is also a member configured to bias the spacer 10*m* toward the upstream side of the direction of rotation of the developing roller 10*d* by an elastic force generated by being elastically deformed. Description will be given below.

Figure 7:
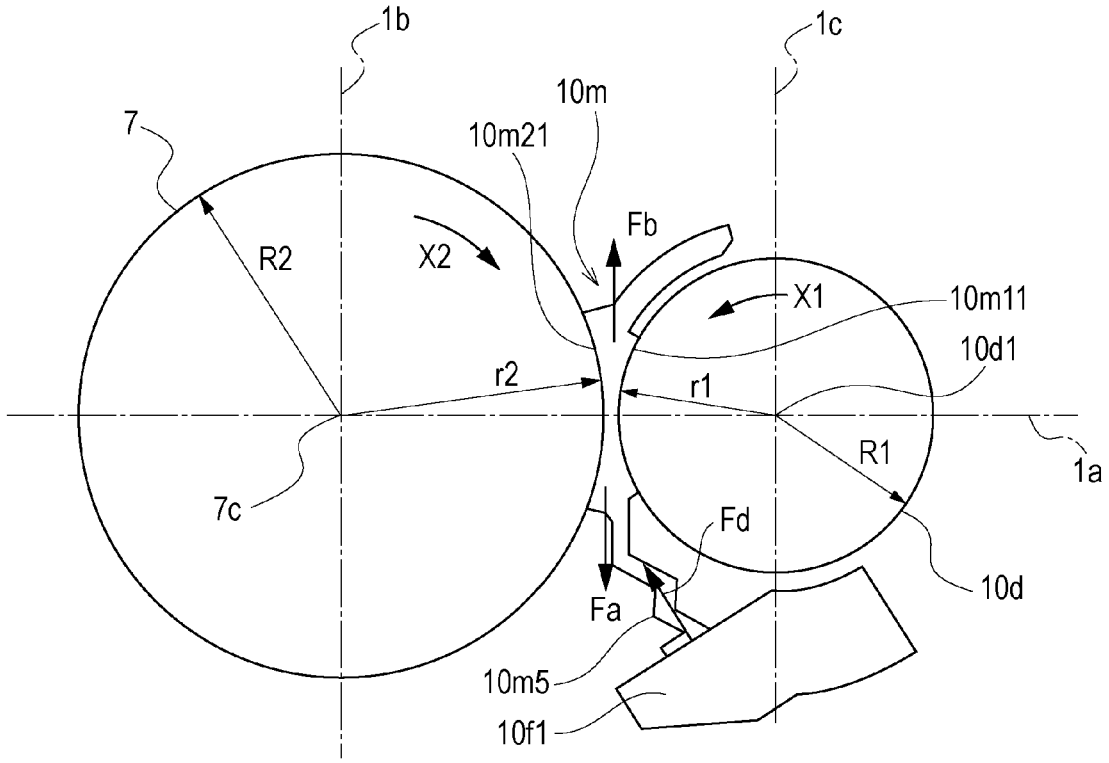
FIG. 7 is an explanatory drawing illustrating a configuration of the developing apparatus.

As illustrated in FIG. 7, the pressing force f illustrated in FIG. 3 brings the spacer 10*m* into abutment with the surfaces of the developing roller 10*d* at a developing roller sliding contact portion 10*p*11 at the developing roller contact surface 10*m*11 and brings the same into abutment with the surface of the photosensitive drum 7 at the photosensitive drum contact surface 10*m*21. With this configuration, the developing roller 10*d* and the photosensitive drum 7 are held at a constant interval.

In a state in which the spacer 10*m* is positioned by the developing roller 10*d* and the photosensitive drum 7 as illustrated in FIG. 7, the biasing member 10*m*5 having elasticity is compressed between the spacer 10*m* and the developing frame 10*f*1. As a result, spacer 10*m* receives a biasing force Fd from the biasing member 10*m*5 in FIG. 7. The biasing force Fd is a force not smaller than "0", directed toward the upstream side in the direction of rotation of the developing roller 10*d* and the photosensitive drum 7.

At this time, a coefficient of elasticity and an amount of compression of the biasing member 10*m*5 having elasticity are selected so as to allow the spacer 10*m* to be positioned between the developing roller 10*d* and the photosensitive drum 7, whereby the magnitude of the biasing force Fd is adjusted.

At the time of image forming, the developing roller 10*d* and the photosensitive drum 7 rotate respectively in directions X1 and X2 in which peripheral surfaces thereof at opposing position rotate in the same direction.

At this time, as illustrated in FIG. 7, the spacer 10*m* receives a force Fa which acts to move the spacer 10*m* to the downstream side of the direction of rotation of the developing roller 10*d* and the photosensitive drum 7 by a sliding contact between the developing roller 10*d* and the photosensitive drum 7.

The force Fa is determined by a frictional force generated on the developing roller contact surface 10*m*11 of the spacer 10*m* and a frictional force generated on the photosensitive drum contact surface 10*m*21.

When the biasing member 10*m*5 having elasticity is compressed between the spacer 10*m* and the developing frame 10*f*1, the spacer 10*m* receives a biasing force Fd, which acts to move the spacer 10*m* to the upstream side of the direction of rotation of the developing roller 10*d* and the photosensitive drum 7 from the biasing member 10*m*5. The force Fd is a force against the force Fa.

Furthermore, a pressing force f generates a force Fb which acts to hold the spacer 10*m* between the developing roller 10*d* and the photosensitive drum 7 acting on the spacer 10*m*. When the spacer 10*m* stays between the developing roller 10*d* and the photosensitive drum 7 without being moved by the rotation of the developing roller 10*d* and the photosensitive drum 7, it means that the forces Fa, Fd, and Fb are balanced, so that an equation Fb+Fd−Fa=0 is satisfied.

There is a case where a frictional force on the spacer 10*m* between the developing roller contact surface 10*m*11 and the photosensitive drum contact surface 10*m*21 rises temporarily for durability thereof. The causes that rise the frictional force include abrasion due to the durability thereof or entry of the foreign substances onto the contact surface and other various causes.

Figure 8:
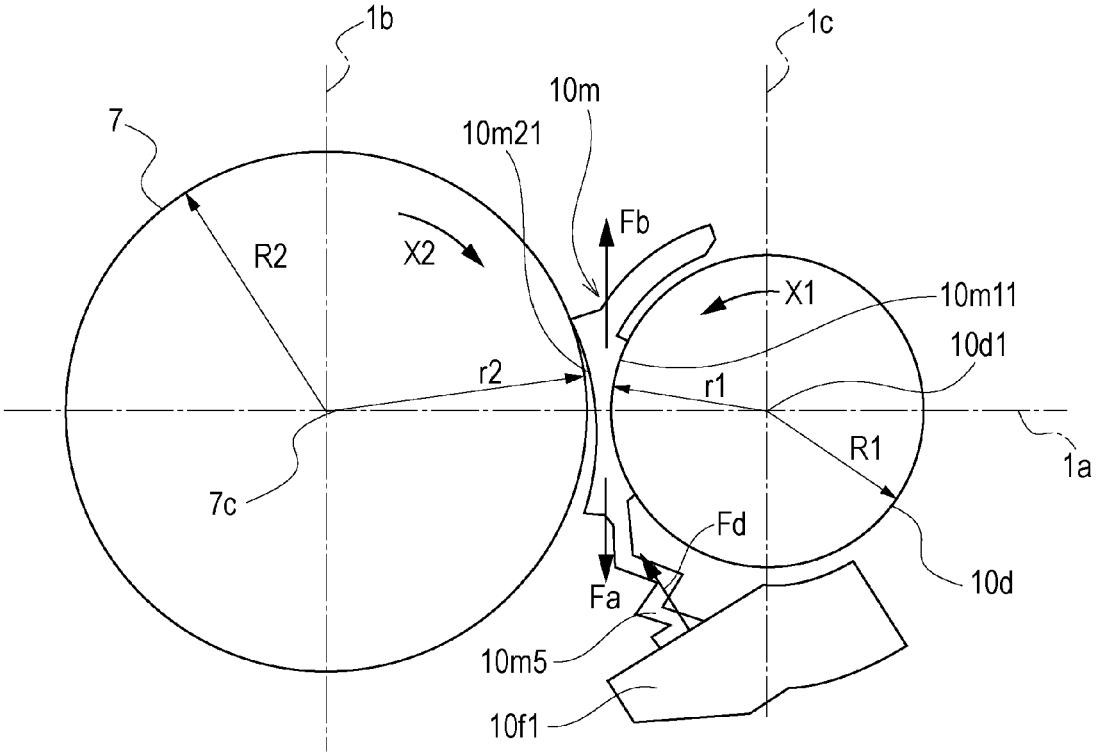
FIG. 8 is an explanatory drawing illustrating a configuration of the developing apparatus.

At this time, as illustrated in FIG. 8, a force Fa which acts to move the spacer 10*m* to the downstream side of the direction of rotation of the developing roller 10*d* and the photosensitive drum 7 is increased, and exceeds a force Fb by which the spacer 10*m* is held between the developing roller 10*d* and the photosensitive drum 7. Consequently, the spacer 10*m* moves to the downstream side of the direction of rotation of the developing roller 10*d*.

At that time, the biasing member 10*m*5 having elasticity is compressed between the spacer 10*m* and the developing frame 10*f*1, and applies a force Fb corresponding to the amount of movement of the spacer 10*m* to the spacer 10 to bias the spacers 10*m* to the upstream side of the direction of rotation of the developing roller 10*d*.

Even though the spacer 10*m* acts to move in association with the rotation of the developing roller 10*d* and the photosensitive drum 7, the biasing force from the biasing member 10*m*5 may keep the spacer 10*m* at a position between the developing roller 10*d* and the photosensitive drum 7 which does not cause a substantial image failure.

The biasing member 10*m*5 provided between the spacer 10*m* and the developing frame 10*f*1 also has a function to restrict the spacer 10*m* to move to the downstream side of the direction of rotation of the developing roller 10*d* or the photosensitive drum 7 when a vibration or an impact is applied to the developing unit 10.

With the configuration as described above, the biasing member 10*m*5 provided on part of the spacer 10*m* contributes to prevent the spacer 10*m* from moving in association with the rotation of the developing roller 10*d* and photosensitive drum 7 at the time of image formation by the elastic force of the biasing member 10*m*5. The spacer 10*m* can stay at a position between the developing roller 10*d* and the photosensitive drum 7 which does not cause a substantial image failure by the biasing member 10*m*5. In this configuration, the spacer 10*m* is prevented from moving in association with the rotation of the developing roller 10*d* and the photosensitive drum 7, and the distance between the photosensitive drum 7 and the developing roller 10*d* can be maintained stably.

Although the biasing member 10*m*5 comes into contact with the developing frame 10*f*5, a configuration in which the developing frame 10*f*5 comes into contact with other portions of the developing unit 10 is also applicable. For example, the biasing member 10*m*5 may come into contact with a separate member supported by the developing frame 10*f*5.

Example 3

Figure 10A:
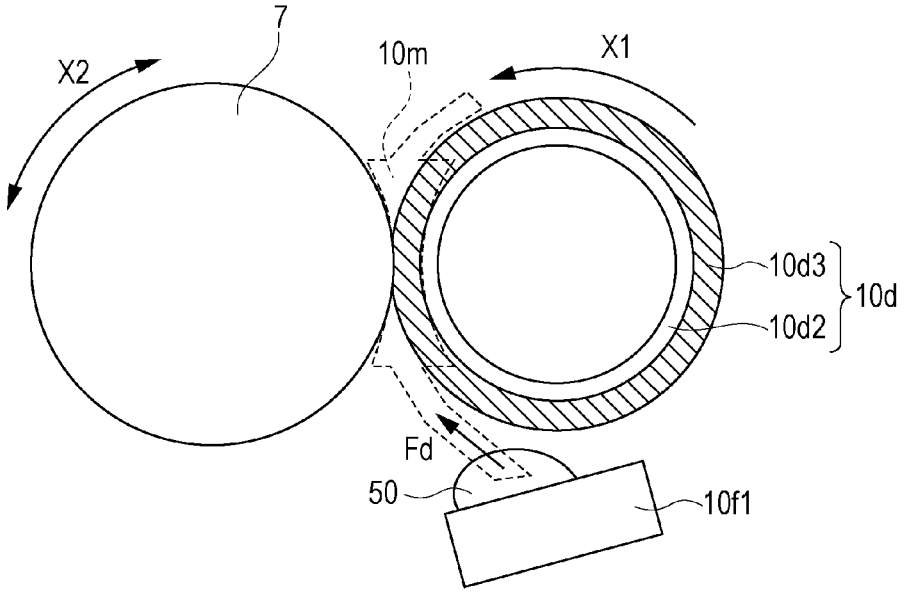
Figure 10B:
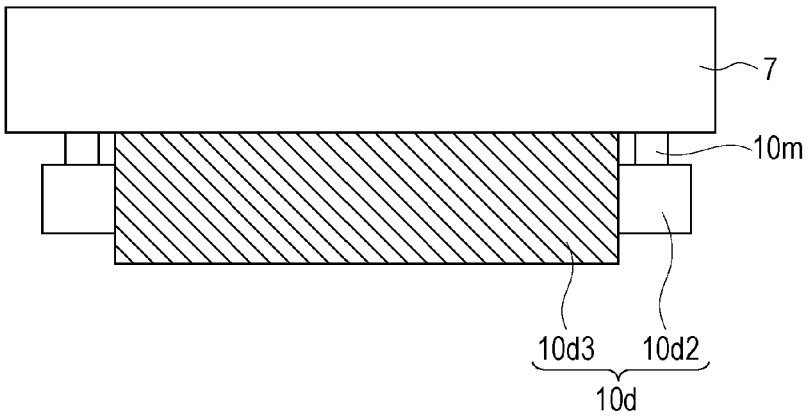
FIG. 10B is an explanatory drawing illustrating an arrangement of the spacer in a longitudinal direction.

In Example 1 described above, a configuration in which the developing roller 10*d* and the photosensitive drum 7 are arranged at a constant space (gap) between the surfaces of each other, that is, a configuration in which the non-contact type developing method is employed has been described. However, this disclosure is not limited thereto. For example, a spacer 10*m* described in the above described Examples may be employed in a contact type developing method as illustrated in FIGS. 10A and 10B. FIG. 10A is a cross-sectional view of the spacer and the developing roller taken along a line perpendicular to the axis of rotation of the developing roller 10*d*. FIG. 10B is an explanatory drawing illustrating an arrangement of the spacer 10*m* in the longitudinal direction of the developing roller 10*d*.

In the configuration illustrated in FIGS. 10A and 10B, the developing roller 10*d* includes an aluminum sleeve 10*d*2 and a rubber layer (elastic member) 10*d*3 provided on the surface thereof. The spacer 10*m* is provide at both end portions of the aluminum sleeve 10*d*2. A rubber layer 10*d*33 of the developing roller 10*d* is in contact with the photosensitive drum 7 by being compressed by a certain amount.

In other words, in FIG. 10, the spacer 10*m* maintains the distance between the developing roller 10*d* and the photosensitive drum 7 (the distance between centers of the both) to be constant in a state in which the surfaces of the developing roller 10*d* and the photosensitive drum 7 are in contact with each other, whereby the amount of compression of the rubber layer 10*d*3 is maintained to be constant.

In Example 5, the biasing member 50 is fixed to the developing frame 10*f*1, and is in contact with the spacer 10*m*. The biasing member 50 is pushed and compressed by the spacer 10*m* when the spacer 10*m* act to move along the direction of rotation X1 of the developing roller 10*d* when the developing roller 10*d* rotates. A biasing force (elastic force) Fd generated by the biasing member 50 being compressed is applied to the spacer 10*m* from the biasing member 50. By the application of the biasing force Fd, the spacer 10*m* is prevented from moving in the direction of rotation X1, returns to its original position (the position where the distance between the developing roller 10*d* and the photosensitive drum 7 is maintained), and is kept at this position.

In conclusion, summary of the common advantages of the examples described thus far will be described below. According to the configurations of the respective examples, the interval guarantee member is prevented from moving when the developer bearing member rotates in a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125717, filed Jun. 14, 2013 which is hereby incorporated by reference herein in its entirety.

What is claimed is:

1. A developing apparatus used in an image forming apparatus, comprising:

a developer bearing member configured to develop a latent image formed on an image bearing member and rotate together with the image bearing member so that opposed surfaces thereof rotate in the same direction;

an interval guarantee member configured to maintain a distance between the developer bearing member and the image bearing member by coming into abutment with the developer bearing member and the image bearing member, the interval guarantee member having:

a first developer bearing member sliding contact portion that comes into sliding contact with the developer bearing member on an upstream side of a line connecting a center of rotation of the developer bearing member and a center of rotation of the image bearing member in the direction of rotation of the developer bearing member, and a first image bearing member sliding contact portion that comes into sliding contact with the image bearing member on the upstream side of the line in the direction of rotation of the image bearing member; and a biasing member configured to apply an elastic force to the interval guarantee member, the elastic force being a force against a force which acts on the interval guarantee member by a sliding contact thereof with the developer bearing member and a sliding contact thereof with the image bearing member, and being a force generated by elastic deformation.

2. The developing apparatus according to claim 1, wherein the interval guarantee member includes:

a second developer bearing member sliding contact portion that comes into sliding contact with the developer bearing member on a downstream side of the line connecting the center of rotation of the developer bearing member and the center of rotation of the image bearing member in the direction of rotation of the developer bearing member; and a second image bearing member sliding contact portion configured to come into sliding contact with the image bearing member on the downstream side of the line in the direction of rotation of the image.

3. The developing apparatus according to claim 1, further comprising a frame configured to support the developer bearing member, wherein the biasing member is positioned between the frame and the interval guarantee member.

4. The developing apparatus according to claim 3, wherein the biasing member is fixed to the frame.

5. The developing apparatus according to claim 1, wherein the biasing member is fixed to the interval guarantee member or formed integrally with the interval guarantee member.

6. The developing apparatus according to claim 1, wherein the interval guarantee member is mounted on the developer bearing member.

7. The developing apparatus according to claim 1, wherein the interval guarantee member maintains a surface of the image bearing member and a surface of the developer bearing member in a state of having an interval therebetween.

8. The developing apparatus according to claim 1, wherein the interval guarantee member maintains a distance between the developer bearing member and the image bearing member in the state in which a surface of the image bearing member and a surface of the developer bearing member.

9. A process cartridge configured to be detachably attachable to an apparatus body of an image forming apparatus, comprising:

an image bearing member on which a latent image is formed; and a developing apparatus, wherein the developing apparatus includes:

a developer bearing member configured to bear developer for developing the latent image formed on the image bearing member and rotate together with the image bearing member so that opposed surfaces thereof rotate in the same direction;

an interval guarantee member configured to maintain a distance between the developer bearing member and the image bearing member by coming into abutment with the developer bearing member and the image bearing member, the interval guarantee member having:

a first developer bearing member sliding contact portion that comes into sliding contact with the developer bearing member on an upstream side of a line connecting a center of rotation of the developer bearing member and a center of rotation of the image bearing member in the direction of rotation, and a first image bearing member sliding contact portion that comes into sliding contact with the image bearing member on the upstream side of the line in the direction of rotation of the image bearing member; and a biasing member configured to apply an elastic force to the interval guarantee member, the elastic force being a force against a force which acts on the interval guarantee member by a sliding contact thereof with the developer bearing member and a sliding contact thereof with the image bearing member, and being a force generated by elastic deformation.

10. The process cartridge according to claim 9, wherein the interval guarantee member includes:

a second developer bearing member sliding contact portion that comes into sliding contact with the developer bearing member on a downstream side of the line connecting the center of rotation of the developer bearing member and the center of rotation of the image bearing member in the direction of rotation of the developer bearing member; and a second image bearing member sliding contact portion configured to come into sliding contact with the image bearing member on the downstream side of the line in the direction of rotation of the image.

11. The developing apparatus according to claim 1, wherein the developing apparatus includes a frame configured to support the developer bearing member, wherein the biasing member is positioned between the frame and the interval guarantee member.

12. The process cartridge according to claim 11, wherein the biasing member is fixed to the frame.

13. The process cartridge according to claim 9, wherein the biasing member is fixed to the interval guarantee member or formed integrally with the interval guarantee member.

14. The process cartridge according to claim 9, wherein the interval guarantee member is mounted on the developer bearing member.

15. The process cartridge according to claim 9, wherein the interval guarantee member maintains a surface of the image bearing member and a surface of the developer bearing member in a state of having an interval therebetween.

16. The process cartridge according to claim 9, further comprising an image bearing member unit configured to hold the developer bearing member, wherein the developing apparatus is movably supported by the image bearing member unit and is biased in a direction of moving the developer bearing member toward the image bearing member.

17. An interval guarantee member configured to maintain a distance between an image bearing member on which a latent image is formed and configured to rotate and a developer bearing member configured to rotate together with the image bearing member so that opposed surfaces thereof rotate in the same direction, comprising:

a distance maintaining member configured to maintain the distance between the image bearing member and the developer bearing member by coming into abutment with the image bearing member and the developer bearing member;

a first developer bearing member sliding contact portion that comes into sliding contact with the developer bearing member on an upstream side of the line connecting the center of rotation of the developer bearing member and the center of rotation of the image bearing member in the direction of rotation of the developer bearing member;

an image bearing member sliding contact portion configured to come into sliding contact with the image bearing member on the upstream side of the line in the direction of rotation of the image; and a biasing member configured to apply an elastic force to the interval guarantee member, the elastic force being a force against a force which acts on the interval guarantee member by a sliding contact thereof with the developer bearing member and a sliding contact thereof with the image bearing member, and being a force generated by elastic deformation.

18. The interval guarantee member according to claim 17, further comprising:

a second developer bearing member sliding contact portion that comes into sliding contact with the developer bearing member on a downstream side of the line connecting the center of rotation of the developer bearing member and the center of rotation of the image bearing member in the direction of rotation of the developer bearing member; and a second image bearing member sliding contact portion configured to come into sliding contact with the image bearing member on the downstream side of the line in the direction of rotation of the image.

19. The interval guarantee member according to claim 17, wherein the interval guarantee member maintains a surface of the image bearing member and a surface of the developer bearing member in a state of having an interval therebetween.

20. The interval guarantee member according to claim 17, wherein the interval guarantee member maintains the distance between the image bearing member and the developer bearing member in a state in which the surface of the image bearing member and the surface of the developer bearing member are apart from each other.

* * * * *